US005347968A

United States Patent [19]

Johnson, Jr.

[11] Patent Number: 5,347,968

[45] Date of Patent: Sep. 20, 1994

[54] INTEGRAL AIR COMPRESSION SYSTEM

[75] Inventor: John L. Johnson, Jr., Brimfield, Ill.

[73] Assignee: Caterpillar Inc., Peoria, Ill.

[21] Appl. No.: 65,729

[22] Filed: May 24, 1993

[51] Int. Cl.[5] ..... F02D 13/04

[52] U.S. Cl. ..... 123/320

[58] Field of Search ..... 123/320, 321

[56] References Cited

U.S. PATENT DOCUMENTS

| | | | |
|---|---|---|---|
| 993,356 | 5/1911 | Pollett . | |
| 1,539,024 | 5/1925 | Robinson . | |
| 1,741,731 | 12/1929 | Nordensson . | |
| 1,917,429 | 7/1933 | Christensen . | |
| 1,934,880 | 11/1933 | Pyk et al. | 230/56 |
| 2,391,972 | 1/1946 | Hufford et al. | 103/54 |
| 2,628,015 | 2/1953 | Neugebauer et al. | 230/56 |
| 3,162,357 | 12/1964 | Burion et al. | 230/56 |
| 3,208,439 | 9/1965 | Ulbing | 123/46 |
| 3,220,392 | 11/1965 | Cummins | 123/321 |
| 3,405,699 | 10/1968 | Laas | 123/320 |
| 4,115,037 | 9/1978 | Butler | 417/341 |
| 4,174,687 | 11/1979 | Fuhrmann | 123/321 |
| 4,429,532 | 2/1984 | Jakuba | 60/600 |
| 4,485,780 | 12/1984 | Price et al. | 123/321 |
| 4,700,663 | 10/1987 | Dunn | 123/1 R |
| 4,848,289 | 7/1989 | Mereely | 123/320 |
| 5,161,501 | 11/1992 | Hu | 123/321 |

FOREIGN PATENT DOCUMENTS

| | | | |
|---|---|---|---|
| 60-182323 | 9/1985 | Japan | 123/321 |

*Primary Examiner*—David A. Okonsky
*Attorney, Agent, or Firm*—Diana L. Charlton

[57] ABSTRACT

Air compression systems for internal combustion engines are utilizing an integral part of the engine to produce the compressed air necessary for operating the brakes of a vehicle. The ability to produce compressed air from an integral part of the engine is important in order to reduce the cost and weight associated with the engine and to increase performance capability and reliability. The integral air compression system includes a valve means associated with one of a plurality of combustion chambers. A housing is connected to a cylinder head and has first and second bore. A master piston is disposed within the first bore to define a first oil chamber. A slave piston is disposed within the second bore to define a second oil chamber. A means fluidly connects the first and second oil chambers. The master piston is forced toward the first oil chamber when another one of the combustion chambers is in the exhaust stroke. The second oil chamber becomes pressurized and forces the slave piston to open the valve means during the compression stroke of the one combustion chamber allowing compressed air to flow through a passage in the head and into a storing means. A means for monitoring the pressure in the storing means is utilized to control the integral air compression system.

12 Claims, 1 Drawing Sheet

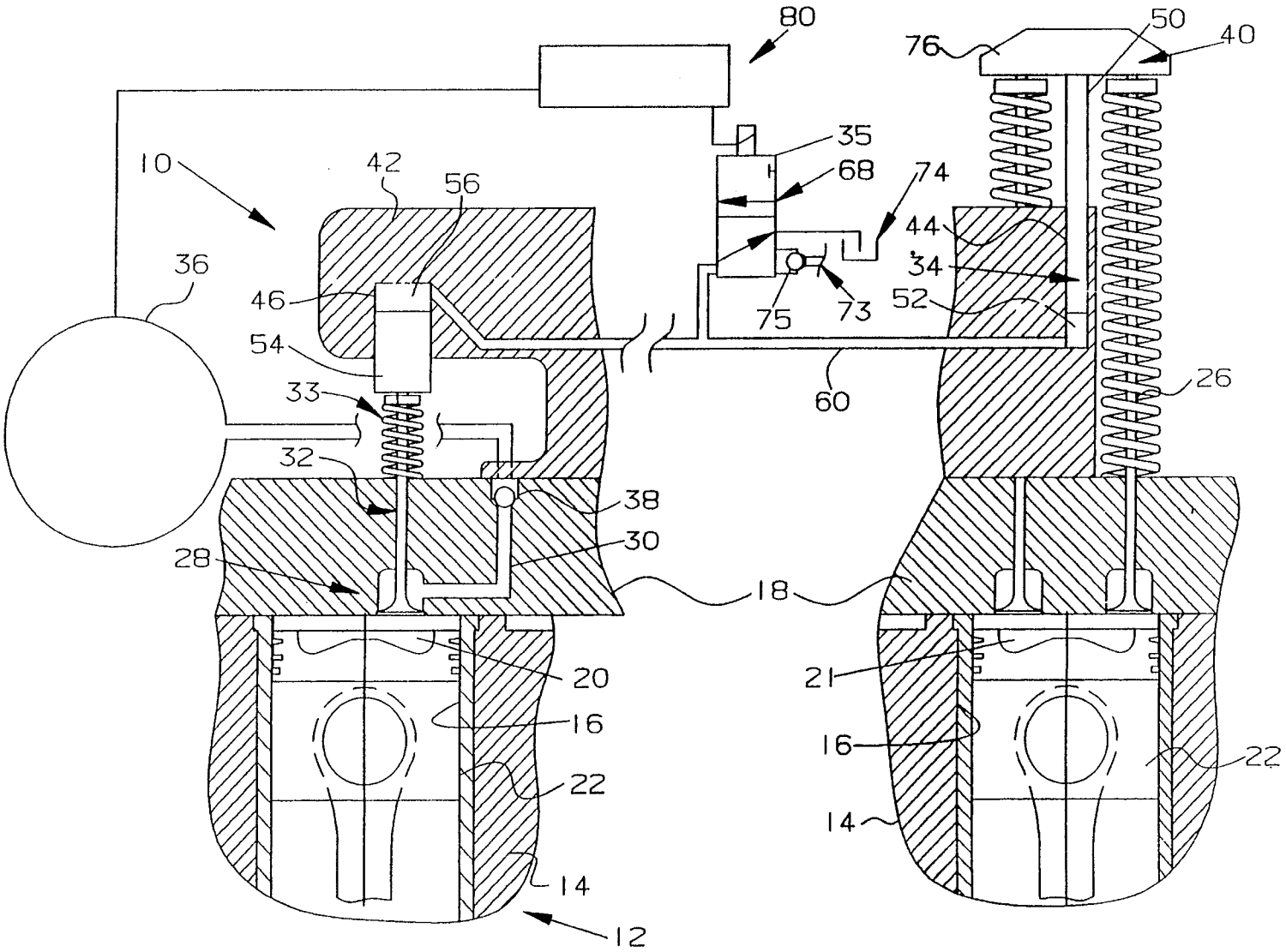
40
50
76
26
22
74
44
34
52
35
68
73
75
60
80
18
21
16
14
38
30
20
16
22
14
12
56
42
46
54
33
32
28
10
36

INTEGRAL AIR COMPRESSION SYSTEM

DESCRIPTION

1. Technical Field

This invention relates to internal combustion engines and more particularly to an integral air compression system therefor.

2. Background Art

Air compression systems for internal combustion engines normally include a separately mounted air compressor which produces compressed air mainly for the purpose of operating the brakes of a vehicle. The separately mounted air compressor increases the overall cost and weight of the internal combustion engine, and due to the horsepower needed by the engine to drive the air compressor even when compressed air is not in demand, overall engine reliability and performance is decreased and fuel consumption is increased. For these reasons, it is known in the prior art to eliminate the separately mounted air compressor and to utilize one or more of the engine's cylinders as a compressed air source. However, the prior art generally relates to systems which draw compressed air from the cylinders on a full-time basis. The inability of the prior art to control when the cylinders are utilized as a compressed air source may hamper engine performance by reducing power within the cylinders during normal operation.

One prior art reference discloses a electronically controlled air compression system wherein the compressed air is devoted to driving the engine's turbocharger. This system discloses an electronic control means which sends a control signal to actuate the intake and exhaust means independently so that the compressed air is drawn from the engine's cylinder in response to specific operating parameters. The compressed air is then immediately directed to drive the engine's turbocharger. The ability of this system to respond to engine parameters substantially eliminates the performance problems which may plague full-time dedicated air compression systems. However, the electronic control means is a complicated and expensive system which increases the overall cost of the engine and is specific for driving the turbocharger.

In the present invention, the addition of a few components to the engine allows for part-time utilization of one cylinder to act as a compressed air source for operating the vehicle's brakes. Since the typically separately mounted and driven air compressor is eliminated and fewer parts are used, the present invention minimizes cost, weight, engine size, parasitic load, and fuel consumption.

DISCLOSURE OF THE INVENTION

In one aspect of the present invention an integral air compression system is provided for an internal combustion engine having a block defining a plurality of cylinders. A head is mounted in closing relation to the cylinder block to define a plurality of combustion chambers. A piston is reciprocally disposed within each of the combustion chambers and movable between a top dead center position and a bottom dead center position sequentially defining an intake stroke, a compression stroke, an expansion stroke, and an exhaust stroke. Exhaust means are operatively associated with each combustion chamber and permit a flow of gas out of the combustion chambers during the exhaust stroke. The air compression system includes means defining a passage disposed within the head in communication with one of the plurality of combustion chambers, valve means for controlling communication between the one combustion chamber and the passage with the valve means being movable between closed and open positions, means for selectively moving the valve means to the open position to permit a flow of air out of the one combustion chamber during the compression stroke, and means connected to the passage for storing the flow of air expelled from the one combustion chamber.

The disadvantage of the prior art is that compressed air is drawn from the cylinders of an engine on a full-time dedicated basis which reduces the performance and reliability of the engine by reducing engine power. Other prior art systems eliminate this problem by introducing an electronic control system which increases the cost of the engine significantly. The present invention overcomes the disadvantages of the prior art by utilizing valve means opening under specific operating conditions to permit the selective flow of compressed air out of one of the combustion chambers so that engine performance is not compromised. The present invention requires few components and is simple and economical thereby minimizing cost, weight, engine size, parasitic load, and fuel consumption.

BRIEF DESCRIPTION OF THE DRAWINGS

The drawing is a diagrammatic sectional view illustrating an internal combustion engine including an embodiment of the present invention.

BEST MODE FOR CARRYING OUT THE INVENTION

An integral air compression system 10 for an internal combustion engine 12 having a cylinder block 14 defining a plurality of cylinders 16 is illustrated in the drawing. A head 18 is mounted in closing relation to the cylinder block 14 to define a plurality of combustion chambers, two of which are shown at 20 and 21. A piston 22 is reciprocally movable within each of the cylinders 16 between a top dead center position (TDC) and a bottom dead center position (BDC) to sequentially define an intake stroke, a compression stroke, an expansion stroke, and an exhaust stroke. Exhaust means 26 are shown which are operatively associated with each combustion chamber 20,21 for permitting a flow of gas out of the combustion chambers 20,21 during the exhaust stroke. Fuel injection means (not shown) are operatively associated with each combustion chamber 20,21 for injecting a preselected amount of fuel into the combustion chambers 20,21 during the compression stroke. It should be noted that any other suitable method for adding fuel into the the combustion chambers can be used.

A passage 30 is defined within the head 18 and communicates with the combustion chamber 20. A valve means 32, such as a poppet valve, is disposed within the head 18 for controlling communication between the combustion chamber 20 and the passage 30. The valve means 32 is movable between a normally closed position and an open position. The valve means 32 includes a means 33 for resiliently biasing the valve means 32 to the closed position to interrupt communication between the combustion chamber 20 and the passage 30.

A means 34 for selectively moving the valve means 32 to the open position is provided to permit a flow of air out of the combustion chamber 20 during the compression stroke. The moving means 34 includes a two position solenoid valve 35 operatively associated with the valve means 32 and movable between the first and second positions. A means 36, such as a storage tank, is connected to the passage 30 for storing the flow of air expelled from the combustion chamber 20. A first check valve 38 is disposed within the passage to prevent air in the storing means 36 from flowing back to the combustion chamber 20. The moving means 34 includes a means 40 for timing the opening of the valve means 32 during the compression stroke of the combustion chamber 20. The timing means 40 is operatively associated with the exhaust means 26 on the combustion chamber 21.

A housing 42 is connected to the cylinder head 18 and has a first annular bore 44 operatively associated with the timing means 40. The first bore 44 extends vertically through the housing 42 and is positioned substantially over the combustion chamber 21. The housing 42 has a second annular bore 46 operatively associated with the combustion chamber 20. The moving means 34 includes a master piston 50 which is slidably disposed within the first bore 44 to define a first oil chamber 52. The moving means 34 further includes a slave piston 54 in contacting relationship with the valve means 32. The slave piston 54 is slidably disposed in the second bore 46 to define a second oil chamber 56. A means 60, such as a drilled hole, is provided in the housing 42 for fluidly connecting the first and second oil chambers 52,56.

A means 68 for maintaining the fluid level within the connecting means 60 and the first and second oil chambers 52,56 is located within the housing 42. The maintaining means 68 includes the valve 35 in fluid communication with the connecting means 60. A means 73 for supplying the integral air compression system 10 with a source of oil and a means 74 for draining the oil from the integral air compression system 10 is connected to the valve 35. A second check valve 75 is provided within the oil supplying means 73 to prevent oil from the connecting means 60 from flowing back to the oil supplying means 73. The valve 35 selectively controls the fluid communication with the connecting means 60.

The timing means 40 includes an exhaust bridge 76 connected to the master piston 50 and the exhaust means 26 on the combustion chambers 21. It should be noted that the timing means 40 may be any suitable form of actuation device capable of actuating the exhaust means 26. The exhaust bridge 76 is connected with the master piston 50 for pressurizing the fluid in the connecting means 60 and the first and second oil chambers 52,56 during the exhaust stroke of the piston 22 of the combustion chambers 21.

A means 80 for monitoring the pressure within the storing means 36 and the engine load, such as an electronic sensor, is operatively associated with the valve 35. It should be understood that a mechanical sensor or any other suitable monitoring sensor can be used to monitor the pressure within the storing means 36 and the engine load.

INDUSTRIAL APPLICABILITY

In use, the pistons 22 within the combustion chambers 20 are sequentially timed in a well-known fashion to provide the intake stroke, compression stroke, expansion stroke, and the exhaust stroke of a four cycle engine. The timing of the four cycle engine produces relationships between the combustion chambers, such as, the exhaust stroke of the combustion chamber 21 corresponds to the compression stroke of the combustion chamber 20.

The electronic sensor 80 monitors the air pressure within the storage tank 36 and the engine load. When the air pressure within the storage tank 36 is less than 696 kPa (101 psi) and the engine load is less than 80%, the valve 35 moves to the first position allowing oil from the supplying means 73 to fill the connecting means 60 and the first and second oil chambers 52,56. The second check valve 75 prevents oil within the connecting means 60 from returning to the supplying means 73. The first position of the valve 35 blocks the connecting means 60 from the draining means 74. Furthermore, when the air pressure within the storage tank 36 is less than 696 kPa (101 psi) and the engine load is less than 80%, the fuel injection means to the combustion chamber 20 is shut off and the addition of fuel into the combustion chamber 20 is interrupted.

During the exhaust stroke of the combustion chamber 21, the exhaust bridge 76 is operated in a conventional manner to actuate the exhaust means 26 thereby allowing gas to flow out of the combustion chamber 21. Simultaneously, the exhaust bridge 76 acts upon the master piston 50 forcing the piston 50 towards the first oil chamber 52. The oil from the first fluid chamber 52 is forced through the drilled hole 60 and is forced into the second oil chamber 56. When the valve 35 is in the first position, the second oil chamber 56 becomes pressurized. The increased pressure within the second oil chamber 56 acts upon the slave piston 54 forcing the piston 54 to actuate the valve means 32 to the open position. Because the combustion chamber 20 is in the compression stroke, compressed air is expelled through the open valve means 32 and flows into the storage tank 36. Since the fuel injection means is shut off, the possibility of fuel entering the storage tank 36 along with the compressed air is eliminated. The first check valve 38 prevents the compressed air within the storage tank 36 from returning to the combustion chamber 20.

When the air pressure within the storage tank reaches 827 kPa (120 psi), as monitored by the electronic sensor 80, the valve 35 moves to the second position allowing oil to flow through the valve 35 and into the drain 74 so that the second oil chamber 56 is not pressurized. Additionally, the fuel injection means is turned on and the addition of fuel into the combustion chamber 20 is permitted.

Whenever the pressure within the storage tank 36 drops below 593 kPa (86 psi), it is an indication that the electronic sensor 80 has not signaled the valve 75 to move into the first position. Regardless of the engine load at that time, the electronic sensor 80 has an additional feature which will signal the valve 35 to move to the first position when the pressure in the storage tank 36 is less than 593 kPa (86 psi) and moves the valve 35 to the second position when the pressure within the storage tank 36 reaches 763.9 kPa (110 psi). Engine load requirements are not considered when the pressure within the storage tank 36 reaches unacceptable levels so that compressed air is available.

It should be noted that the pressure and engine load requirements for the integral air compression system are not limited to the specific pressures and loads described above, but could be any preestablished levels desirable for use with the system.

In view of the above, it is apparent that the present invention provides an improved means for producing and storing compressed air. The present invention utilizes a simplified design comprising the use of a master piston actuated by an exhaust bridge during the exhaust stroke of one combustion chamber to actuate a valve means during the compression stroke of another combustion chamber under specific operating specifications monitored by an electronic sensor. The actuated valve means allows compressed air to flow from the combustion chamber into a storage tank. The present invention adds a few components to the engine allowing for part-time utilization of one cylinder to function as a compressed air source while eliminating the use of a separately mounted air compressor.

I claim:

1. An integral air compression system for an internal combustion engine having a block defining a plurality of cylinders, a head mounted in closing relation to the cylinder block to define a plurality of combustion chambers, a piston reciprocally disposed within each of the cylinders and movable between top dead center and bottom dead center positions sequentially defining an intake stroke, a compression stroke, an expansion stroke, and an exhaust stroke, and exhaust means operatively associated with each combustion chamber for permitting a flow of gas out of the combustion chamber during the exhaust stroke, comprising:

means defining a passage in the head in communication with one of the plurality of combustion chambers;

valve means for controlling communication between the one combustion chamber and the passage, the valve means being movable between closed and open positions;

means for selectively moving the valve means to the open position to permit a flow of air out of the one combustion chamber during the compression stroke; and means connected to the passage for storing the flow of air expelled from the one combustion chamber.

2. The integral air compression system as in claim 1, wherein the moving means includes means for timing the opening of the valve means during the compression stroke of the piston of the one combustion chamber.

3. The integral air compression system as in claim 2, wherein the timing means is operatively associated with the exhaust means on another one of the combustion chambers.

4. The integral air compression system as in claim 3, including a housing connected to the cylinder head, the housing having a first bore operatively associated with the timing means and positioned substantially over said another one of the combustion chambers and a second bore operatively associated with the one combustion chamber.

5. The integral air compression system as in claim 4, wherein the moving means includes a master piston slidably disposed within the first bore and operatively associated with the timing means to define a first oil chamber and a valve being movable between a first and a second position fluidly connected to the connecting means.

6. The integral air compression system as in claim 5, wherein the moving means includes a slave piston in contacting relationship with the valve means and being slidably disposed in the second bore to define a second oil chamber.

7. The integral air compression system as in claim 6, including means for fluidly connecting the first and the second oil chambers.

8. The integral air compression system as in claim 7, including means for maintaining the fluid level within the connecting means and the first and second oil chambers.

9. The integral air compression system as in claim 8, wherein the maintaining means includes the valve selectively controlling fluid communication with the connecting means.

10. The integral air compression system as in claim 9, wherein the timing means includes an exhaust bridge connected to the master piston and the exhaust means on said another one of the combustion chambers, the exhaust bridge being operatively associated with the master piston for pressurizing the fluid in the connecting means and the first and second oil chambers during the exhaust stroke of the piston of said another one of the combustion chambers when the valve is in the first position.

11. The integral air compression system as in claim 10, including means for resiliently biasing the valve means to the closed position.

12. The integral air compression system as in claim 11, including means for monitoring the engine load and the the pressure within the storing means so that at preestablished load and pressure conditions the valve may be moved to the first and the second positions.

* * * * *